United States Patent [19]

Sukharevsky

[11] Patent Number: 4,587,829

[45] Date of Patent: May 13, 1986

[54] LIGHTWEIGHT, HIGH PRESSURE FASTENER INSTALLATION TOOL AND SYSTEM

[75] Inventor: Boris P. Sukharevsky, Fullerton, Calif.

[73] Assignee: Huck Manufacturing Co., Irvine, Calif.

[21] Appl. No.: 751,686

[22] Filed: Jul. 3, 1985

[51] Int. Cl.[4] ..... B21J 15/34

[52] U.S. Cl. ..... 72/391; 29/243.52

[58] Field of Search ..... 72/391, 453.17, 114; 29/243.52

[56] References Cited

U.S. PATENT DOCUMENTS

| | | | |
|---|---|---|---|
| 3,451,248 | 6/1969 | Bell | 72/453.17 |
| 3,457,763 | 7/1969 | Freeman | 72/453.17 |
| 3,557,597 | 1/1971 | Helsop | 72/453.17 |
| 3,714,810 | 2/1973 | Boyd | 72/391 |
| 4,074,554 | 2/1978 | Summerlin | 72/391 |
| 4,259,858 | 4/1981 | Freeman | 72/453.17 |
| 4,310,056 | 1/1982 | Olsson | 72/391 |
| 4,368,631 | 1/1983 | Tanikawa | 72/391 |

*Primary Examiner*—Leon Gilden

*Attorney, Agent, or Firm*—Harness, Dickey & Pierce

[57] ABSTRACT

A piston-cylinder, pull type installation tool operable from a source of high hydraulic pressure for setting large diameter swage type fasteners including a pin and a collar by application of a relative axial force thereto with the tool having a pair of piston-cylinder combinations arranged in tandem with both of the piston-cylinders being utilized to provide the pull force to swage the collar to the pin and with only one of the piston-cylinders being utilized to provide the collar ejection force to eject the collar from the tool and with at least some of the hydraulic porting being provided through the tandem piston construction.

19 Claims, 3 Drawing Figures

LIGHTWEIGHT, HIGH PRESSURE FASTENER INSTALLATION TOOL AND SYSTEM

SUMMARY BACKGROUND OF THE INVENTION

The present invention relates to a pull type installation tool and system for setting fasteners by a relative axial force applied to the fastener and more particularly to a high pressure, hydraulically actuated installation tool.

The pull tool of the present invention is directed to the installation of fasteners mainly of the two piece lockbolt or swage type such as that illustrated in U.S. Pat. No. 3,915,053 to J. Ruhl, issued Oct. 28, 1975, U.S. Pat. No. 2,531,048 to L. Huck, issued Nov. 21, 1950 and U.S. Pat. No. 4,208,943 to W. Smith, issued June 24, 1980.

As seen from the noted patents, lockbolts are installed by applying a relative axial force between a pin and a collar by the pull stroke of a piston-cylinder type tool; the tool has a jaw assembly to grip a pull portion of the pin and a swage anvil which engages the collar. When the relative axial force attains a preselected magnitude a swage cavity of the swage anvil moves over the collar moving the collar material radially inwardly into lock-grooves on the pin. The relative axial force increases until the pull or pintail portion of the pin is severed at a weakened breakneck groove. This completes the installation except for the removal of the tool from the swaged collar. With small diameter fasteners the swage cavity of the tool anvil can be constructed to be self releasing from the swaged collar in response to pin break; however, with larger diameter fasteners (from around $\frac{3}{8}$ inch to as large as $1\frac{3}{8}$ inch nominal diameter of the pin shank) this may not be desirable because of the magnitude of recoil loads involved at pin break. Thus in the latter instance the tool is provided with a structure to provide ejection of the collar from the swage cavity of the tool by a reverse, relative axial pushing force applied to the collar on a return stroke of the tool.

Thus the present invention is more specifically directed to installation tools capable of developing significantly high (relative axial) pull loads i.e. from about 23,000 pounds pull for a $\frac{3}{8}$ inch diameter fastener to about 110,000 pounds pull for a $1\frac{3}{8}$ inch diameter fastener (nominal shank diameter of the pin). Such tools are conventionally operable from a source of relatively high hydraulic pressure; in this regard, fluid pressures of from around 5,500 psi to around 8,500 psi are common.

As noted, the setting loads required by the tool increases as the size of the fastener increases and hence the tool size and weight increases as well. Thus with large diameter fasteners, i.e. a nominal pin diameter of around $\frac{3}{8}$" and greater, the installation tools heretofore used can weigh from around 13 pounds for a tool for setting a $\frac{3}{8}$" diameter fastener to around 65 pounds for a tool for setting a $1\frac{3}{8}$" diameter fastener; often times counterweight systems are required to facilitate manual handling of the tools.

It is common for such installation tools to utilize a single piston-cylinder arrangement. In the present invention it has been found that a significant weight and size reduction can be realized by utilizing a tandem, two piston-cylinder arrangement. At the same time a novel structure and porting system is provided whereby one of the two cylinders is defined and operative only on one side of its associated piston such that this piston-cylinder combination is effective only during the pull stroke operation of the tool. Thus both of the piston-cylinder combinations will be utilized to provide the high axial loads required for the installation of the fastener on the pull stroke while only one of the piston-cylinder combinations will be utilized to provide the lower loads for the return stroke and ejection of the collar from the swage cavity of the tool anvil. As will be seen, the result is an installation tool of a significantly reduced size and weight. Thus tools constructed in accordance with the present invention, by comparison to the weight of prior tools as noted above, will weigh around 4.5 pounds for a tool developing a 23,000 pound pull for setting a $\frac{3}{8}$" diameter fastener to around 28.0 pounds for a tool developing a 110,000 pound pull for setting a $1\frac{3}{8}$" diameter fastener. In both cases the cylinders of the tools were essentially constructed of the same type of ferrous materials such as 4340 alloy steel.

In addition to the above, the installation tool of the present invention lends itself to a simplified construction facilitating its economical manufacture.

In the construction of pneumatically actuated tools for setting blind rivets, it is known to use multiple pistons and cylinders arranged in tandem especially where relatively low pneumatic pressures are anticipated. Examples of such tandem piston and cylinder constructions, which are pneumatically actuated, are shown in the following patents: U.S. Pat. Nos. 3,451,248 to W. Bell, issued June 24, 1969, 3,457,763 to R. B. Freeman, issued July 29, 1969, 3,523,441 to W. Bell et al, issued Aug. 11, 1970, 3,557,597 to V. L. Heslop et al, issued Jan. 26, 1971, 3,714,810 to C. R. Boyd, issued Feb. 6, 1973, 4,259,858 to R. B. Freeman, issued Apr. 7, 1981. Structures of the type shown in these patents, however, are not directed to the same problems as the high pressure, high relative axial pull load, hydraulically actuated tools of the present invention.

Thus it is an object of the present invention to provide a novel installation tool and system for setting fasteners by the application of a relative axial force with the tool having a novel tandem piston-cylinder construction whereby a significant reduction in size and weight can be realized over tool constructions heretofore used for such applications.

It is another object of the present invention to provide a novel pull type installation tool and system having a tandem piston-cylinder construction in which less than all of the piston-cylinders are utilized for collar ejection on a return stroke whereby a compact, lightweight construction can be utilized.

It is another object of the present invention to provide an installation tool construction which is of a simplified construction permitting it to be manufactured economically.

It is a general object of the present invention to provide a novel pull type installation tool having a compact, lightweight construction.

Other objects, features, and advantages of the present invention will become apparent from the subsequent description and the appended claims, taken in conjunction with the accompanying drawings, in which:

Figures 1, 1A, 2:
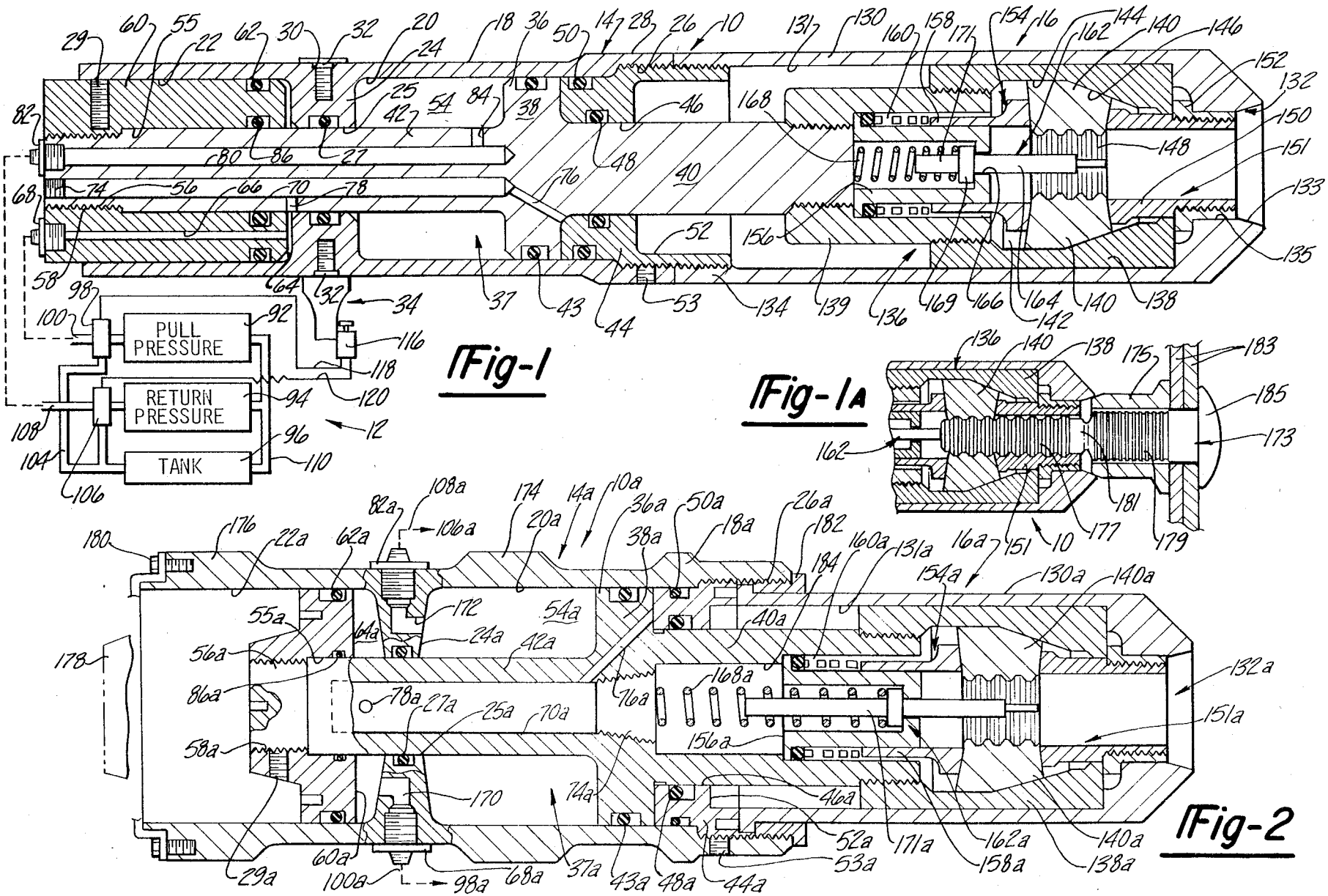
FIG. 1 depicts an installation tool system including a longitudinal sectional view of one form of an installation tool embodying features of the present invention with the installation tool shown in a schematic relationship to a source of hydraulic power and a control circuit.
FIG. 1A is a fragmentary view of the installation tool of FIG. 1 shown as applied to a lockbolt type fastener prior to the initiation of the installation cycle.
FIG. 2 is a longitudinal sectional view of a modified form of an installation tool embodying features of the present invention.

Looking now to FIG. 1, the installation tool and system of the present invention are shown and include an installation tool 10 and a hydraulic power supply 12. The tool 10 includes a piston-cylinder assembly 14 and a removable nose assembly 16.

The piston-cylinder assembly 14 includes a generally tubular housing 18 which is of a one piece construction and which has a forward cylinder cavity 20 and a rearward cylinder cavity 22 separated by an annular web or wall 24. The separating wall 24 has a central through bore 25 and an annular fluid seal 27 supported in a groove therein. The forward cavity 20 and rearward cavity 22 are generally of the same inside diameter; however, a threaded counterbore 26, of enlarged inside diameter, is located at the outer end 28 of the forward cylinder cavity 20; the outer end 28 is of an increased outside diameter relative to the remainder of the housing 18. An annular groove 30 is formed in the outer surface of housing 18 in radial alignment with the separating wall 24 and is provided with a plurality of circumferentially spaced, threaded bores for receiving fasteners 32 for the attachment of a handle assembly 34. Thus it can be seen that the housing 18 is of a rather simple overall construction and shape which can be relatively inexpensive to manufacture.

The tool 10 includes a tandem piston assembly 37 which comprises a forward piston construction 36 having an integrally formed piston head 38, a forwardly extending rod portion 40 and a rearwardly extending rod portion 42. The piston head 38 is slidably supported within forward cylinder cavity 20 and has an annular seal 43 located in a groove in its outer surface to provide a fluid seal therewith.

A generally annular gland nut 44 is threadably secured within the counterbore 26 at the outer end 28 of housing 18 and has a central bore 46 for slidably supporting the forward rod portion 40. An annular seal 48 located in a groove in central bore 46 provides a fluid seal with the forward rod portion 40; at the same time, a seal 50 in an annular groove in an outer surface of gland nut 44 provides a fluid seal with the forward cylinder cavity 20 of housing 18. The gland nut 44 has an enlarged counterbore 52, which as will be seen, provides clearance for an operative, associated portion of the nose assembly 26. A radial set screw 53 inhibits rotation between the gland nut 44 and housing outer end 28. Thus, as can be seen, from FIG. 1, the gland nut 44 along with the web 24 and forward cylinder cavity 20 define a forward hydraulic cylinder 54.

The rearward rod portion 42 is slidably supported within web bore 25 with seal 27 providing a fluid seal therewith and, with a connected piston head 60, defines a rearward piston construction. Thus the rearward rod portion 42 terminates at its free end in a reduced diameter threaded portion 56 which is threadably engaged with a threaded portion 58 of a through bore 55 in piston head 60. A radial set screw 29 through piston head 60 holds the piston head 60 from rotation relative to the rear rod portion 42. The piston head 60 is slidably supported within the rearward cylinder cavity 22 and has an annular seal 62 located in a groove in its outer surface to provide a seal with cylinder cavity 22. Thus as can be seen from FIG. 1, the separating wall 24 and the rearward piston structure, including piston head 60, define a rearward hydraulic cylinder 64.

Note that while the forward cylinder 54 has operative cylinder portions defined on opposite sides of forward piston head 38, the rearward cylinder 64 is defined and operative only on one side of the rear piston head 60. Hence, as will be seen, fluid pressure can and is applied to both sides of forward piston head 38 but only to one side of rear piston head 60. Thus the tandem piston assembly 37 will move axially rearwardly in response to fluid pressure applied to one side each of both the forward piston head 38 and rear piston head 60 (for the pull stroke of tool 10) but will move axially forwardly in response to fluid pressure applied only to the opposite side of the front piston head 38 (for the return stroke of tool 10). This is accomplished by fluid passageways in conjunction with the hydraulic power supply 12 as shown in FIG. 1 and as described below.

Thus the rear piston head 60 has a radially offset, axially extending through bore 66 which, at its forward end, communicates with rearward cylinder 64 and, at its rearward end, terminates in an enlarged, threaded portion adapted to receive an appropriate fluid fitting 68. A blind bore 70 extends axially into the rear piston rod portion 42 from its free end to a position proximate the forward piston head 38. A threaded plug 74 blocks the free end of blind bore 70 while a skewed cross bore 76 communicates the inner end of bore 70 with the front portion of forward cylinder 54. A radial cross port 78 in the rear rod portion 42 communicates the blind bore 70 with the front end of rearward cylinder 64. Thus a fluid connection with the source 12 will be simultaneously made to the front ends of both hydraulic cylinders 54 and 64 via fitting 68, through bore 66 to rearward cylinder 64, radial cross port 78, blind bore 70 and skewed port 76 to the front portion of forward cylinder 54.

The rear piston rod portion 42 has a second radially offset, blind bore 80 which extends axially from its free end to a position proximate the forward piston head 38. A fluid fitting 82 is threadably secured in an enlarged threaded bore portion at the free end of blind bore 80. A radial cross port 84 communicates the bore 80 with the rear portion of forward cylinder 54. An annular seal 86 located in a groove in rear piston bore 55 provides a fluid seal with the bore 55 relative to the fluid in rearward cylinder 64. Thus a second fluid connection with the source 12 will be made solely to the rear portion of forward cylinder 54 via fitting 82, blind bore 80, and radial cross bore 84.

The reciprocation of the tandem piston assembly 37 for its pull and return strokes is effectuated by the fluid connections to the source of fluid pressure 12. The source of hydraulic fluid pressure 12 can be of a type such as a Model 940 POWERIG power supply sold by Huck Manufacturing Company and hence the details thereof have been omitted for purposes of simplicity and a general representation of such a suitable sytem has been shown. POWERIG is the registered trademark of Huck Manufacturing Company.

Looking now to FIG. 1, hydraulic source 12 includes a pull pressure section 92, a return pressure section 94 and a tank or reservoir 96. A first control valve 98 is connected between the fluid outlet from the pull pressure section 92 to the piston-cylinder assembly 14 at fitting 68 via conduit 100 and is connected to tank 96 via a common conduit 104. A second control valve 106 is connected between the fluid outlet from the return pressure section 94 to the piston-cylinder assembly 14 at fitting 82 via conduit 108 and is connected to tank 96 via common conduit 104. The fluid inlets of pull pressure section 92 and return pressure section 94 are connected to tank 96 via common conduit 110. The valves 98 and 106 are controlled by the operator via a trigger or control button 116 which can be mounted on the handle 34. Electrical conductors 118 and 120 are representatively shown between trigger 116 and control valves 98 and 106, respectively.

Thus to actuate the tool 10 to its pull stroke, the trigger 116 is depressed; this actuates the first control valve 98 to its pressure condition in which the pull pressure section 92 transmits fluid under pressure to the piston-cylinder assembly 14 via conduit 100 and fitting 68; in this condition the connection from valve 98 to tank 96 via line 104 is blocked. At the same time, the second control valve 106 is actuated to a condition in which the return fluid pressure to conduit 108 from return pressure section 94 is blocked; in this condition the connection from valve 106 to tank 96 via line 104 is opened whereby the piston-cylinder assembly 14 is connected to tank 96 via conduit 108 and fitting 82. With valves 98 and 106 in the noted conditions, hydraulic fluid pressure from pull pressure section 92 is applied to the front cylinder portion of forward cylinder 54 and to the rearward cylinder 64 while the rear cylinder portion of forward cylinder 54 is connected to tank 96. After completion of the pull stroke and setting the fastener in a manner to be described, the operator releases the trigger 116. Now the first control valve 98 is conditioned to block fluid pressure from the pull pressure section 92 to the piston-cylinder assembly 14 and to connect the front cylinder portion of forward cylinder 54 and rearward cylinder 64 to tank 96 via conduit 104; at the same time the second control valve 106 is conditioned such that the hydraulic fluid pressure from return pressure section 94 is applied to the rear cylinder portion of forward cylinder 54 while blocking communication to tank 96. Now the tool 10 is in its return condition (as shown in FIG. 1) and is maintained in this condition until the operator again actuates the trigger 116.

As noted in the prior discussion, tools such as tool 10 are hydraulically actuated with pull pressures from sources such as pull pressure section 92 being of magnitudes of from around 5,500 psi to around 8,500 psi in order to develop a pulling force of from around 23,000 pounds to around 110,000 pounds. In order to cover the range of the later pulling forces, a series of single piston-cylinder tools were used with the diameters of the cylinders increasing across the range. However, in order to inhibit excessive radial expansion of the cylinders due to hoop stresses incurred as a result of the high fluid pressures utilized, the wall thickness of the cylinder walls was increased significantly with increases in cylinder diameter. Radial expansion, while within acceptable stress limits, could still result in excessive radial separation between cylinder wall and piston head seal such that the effectiveness of the fluid seal between the associated piston head and cylinder wall could be impaired. The latter situation becomes aggravated with increasing cylinder diameters. Thus with the single piston-cylinder arrangement, the increase in wall thickness to provide the necessary radial or hoop stiffness and to preclude such excessive radial expansion added appreciably to the weight of the tool. With the present invention, by the use of tandem piston-cylinders, the diameter of the cylinders can be decreased and hence the cylinder wall thickness can be reduced for the same pull load resulting in a significant reduction in weight and overall size in contrast to a comparable single piston-cylinder combination. Thus in one form of the present invention the wall thickness of the cylinder walls is selected to be approximately that thickness sufficient to provide the required hoop stiffness to preclude excessive radial expansion.

In addition, as noted, the rear cylinder cavity 22, being open at its rearward end, is not subjected to hydraulic pressure and hence it does not require a closure structure which must be of sufficient strength to withstand fluid pressures such as are applied to the working portions of cylinders 54 and 64. Thus the result can be a further reduction in weight since the cylinder housing 18 can be open at that end. However, in order to effectively block the otherwise open end of the rear cylinder cavity 22, the piston head 60 is constructed to have an axial length generally the same as that of the rear cylinder cavity 22. This elongated piston head structure also facilitates the connection between the hydraulic lines 100 and 108 and associated fittings 68 and 82. At the same time, the lengthened piston head 60, by blocking the open end of cylinder cavity 22, protects the fluid lines 100, 108 (which are conventionally flexible) and other objects from inadvertently being caught and pinched in an opening at the end of cylinder cavity 22 if a piston of conventional axial length (such as piston head 38) were used. Since the piston head 60 is axially elongated it has a relatively high shear strength; thus while the remainder of the piston-cylinder assembly 14 may be constructed of a ferrous material of suitable strength the piston head 60 can be constructed of a lightweight material, such as aluminum, which adequately compensates, weightwise, for the increase in axial length.

As noted only one active piston and cylinder combination is used to provide the axial pushing force for ejection of the swaged collar from the anvil. With prior constructions, to facilitate collar ejection, it has been desirable, that the axially applied ejection load be approximately no less than around 30% of the pulling force i.e. with a pull load of 23,000 pounds the desired ejection load would be around 7,000 pounds. With an applied hydraulic pull pressure of around 8,500 psi an ejection pressure of around 2,700 psi would be used. With the present invention since only one active piston-cylinder combination is used for ejection, the magnitude of return pressure to provide the desired ejection force is at least around 70% of the pull pressure i.e. for 8,500 psi pull pressure, 6,000 psi return pressure is used. However, in some cases, the return pressure could be of the same magnitude as the pull pressure permitting the pull pressure section 102 and return pressure section 104 to be combined. As a further illustration of the compact construction resulting from the present invention and in one form of the invention, the housing 18 for piston-cylinder assembly 14 can have an outside diameter in the area of cylinders 54, 64 of 1.75 inches and an inside diameter in the same area of 1.562 inches for a tool developing 23,000 pounds pull at around 5,500 psi; for a tool developing 110,000 pounds pull at around 8,500 psi, the housing 18 for piston-cylinder assembly 14 can have an outside diameter in the area of cylinders 54, 64 of 4.25 inches and an inside diameter in the same area of 3.25 inches. In the latter cases the housing 18 is constructed of a ferrous material such as 4340 alloy steel.

As discussed, the tool 10 is constructed for the installation of two piece, lockbolt type fasteners. As such, these fasteners could be set by utilizing a nose assembly such as nose assembly 16 which, as shown, can be of a construction which is generally known.

Looking now to FIG. 1, the nose assembly 16 has a generally cylindrical, outer anvil housing 130 with a through bore 131 which terminates at its forward end in a reduced diameter swage cavity 132 for swaging the collar onto the lockbolt pin; the swage cavity 132 comprises a tapered lead-in portion 133 and a straight throat portion 135. The straight portion 135 is of a generally uniform diameter and defines the smallest diameter to which the collar will be swaged. The housing 130, and hence the nose assembly 16, is secured to the piston-cylinder assembly 14 via an end portion 134 of bore 131 which is threadably connected to the gland nut 44. A collet assembly 136 includes a tubular collet 138 which is slidably supported within anvil housing bore 131. The collet assembly 136 has an adaptor sleeve 139 which is threadably connected at its forward end to the collet 138 and at its rearward end to the outer end of forward piston rod portion 40. Thus the collet assembly 136 will be reciprocated relative to the anvil housing 130 by the reciprocation of the tandem piston assembly 37.

A plurality of gripping jaws 140 are slidably supported within a cavity 142 in collet 138 with the cavity 142 being defined by a straight bore portion 144 connected to a tapered, frusto-conical bore portion 146. The outer surface of the jaws 140 are contoured to generally follow the contour of the cavity 142 such that the jaws 140 will be moved between radially opened and closed positions to release and grip the pull portion of the fastener pin. The jaws 140 are provided with grooves 148 which match pull grooves on the pull portion to facilitate gripping the pin. With the tandem piston assembly 37 in its return position (as shown in FIG. 1), the gripping jaws 140 are normally held open by the engagement of a rear flange of a tubular jaw release sleeve 150 with the front surfaces of jaws 140. The release sleeve 150 is a part of a combination jaw release and collar ejector assembly 151 and hence a flanged cylindrical member 152 is threaded to the forward end of release sleeve 150 to capture the assembly 151 at the front end of the collet 138; thus the front end of the release and ejector assembly 151, including sleeve 150 and cylindrical member 152, is slidably supported for movement within the straight bore portion 135 of swage cavity 132 to eject the swaged collar from the cavity 132 on the return stroke of tandem piston assembly 37. At the same time the back end of assembly 151, on the return stroke, will radially open the jaws 140 to their pin release position.

A jaw follower assembly 154 includes inner and outer telescoping sleeves 156 and 158, respectively, which are generally located within a cavity defined by the juncture of adaptor sleeve 139 and the collet 138. A spring assembly 160 urges the sleeves 156 and 158 apart to thereby normally urge a forward flange on the outer sleeve 158 into engagement with the rear surfaces of jaws 140. This biases the jaws 140 towards their closed or pin gripping position. An ejector pin 162 has a shank portion 164 slidably supported within a reduced diameter bore 166 at the front end of inner sleeve 156. A spring 168 is partially telescoped over a rear shank portion 171 of ejector pin 162 and engages an enlarged head 169 thereon to urge the ejector pin 162 to its forwardmost position (as shown in FIG. 1) in which the forward shank portion 164 is located partially within the confines of the gripping jaws 140.

In operation, a lockbolt pin 173 will be located in aligned bores in workpieces 183 with an enlarged head 185 engaging one side of the workpieces 183 and with a shank portion extending through to the opposite side. The nose assembly 16 of tool 10 is applied to the shank of the lockbolt pin 173 after a flanged collar 175 has been located thereon (see FIG. 1A). The shank of the fastener pin 173 will have a pull portion 177 located within the confines of the jaws 140 with the anvil bore 132 engaging the outer end of the collar 175. The shank of the fastener pin 173 will move the ejector pin 162 rearwardly against the bias of spring 168. When the tool 10 is actuated via the trigger 116, the tandem piston assembly 37 will move rearwardly in its pull stroke moving the collet assembly 136 rearwardy. The jaw follower assembly 154 urges the jaws 140 forwardly against the frusto-conical bore portion 146 whereby they are moved radially inwardly to engage annular pull grooves on the pull portion 177 of the fastener pin 173. As the pull stroke continues the release and ejector assembly 151 is moved rearwardly and the swage cavity 132 moves over the collar 175 swaging it radially inwardly into lock grooves 179 on the pin 173. As the relative axial force increases the shank of the fastener pin 173 is severed at a breakneck groove 181. Now the operator releases the trigger 116 and the tandem piston assembly 37 is actuated to move forwardly to its return position. The front end of collet 138 engages the flange on release sleeve 150 moving the release and ejector assembly 151 forwardly into engagement with the outer end of swaged collar 175 pushing it out of the swage cavity 132. At the same time, the jaw release sleeve 150, on the assembly 151, urges the jaws 140 rearwardly to their radially open position releasing the severed pull portion 177 or pintail which is now ejected from the tool 10 by the ejector pin 162 completing the installation cycle.

Note that the swaging action on the collar is essentially performed by the straight throat portion 135 of swage cavity 132. Self releasing anvils are typically formed in the throat area with a sufficient taper facilitating release of the tool 10 from the collar 175 after swage. The throat portion 135, as described, is relatively straight and hence is not self releasing. Thus, in the present invention, the swaged collar 175 is ejected from the swage cavity 132 by the pushing force applied to the release and ejector assembly 151 as reacted by the anvil housing 130 upon the return stroke of the tandem piston assembly 37.

A modified form of installation tool embodying features of the present invention is shown in FIG. 2 where components similar to like components in the embodiment of FIG. 1 have been given the same numeral designation with the addition of the letter postscript "a" and hence the description of all of the similarly numbered components has not been repeated.

Looking now to FIG. 2, the installation tool **10*a* can be used with the same source of hydraulic power such as the power supply 12 of FIG. 1. The installation tool 10*a* includes piston-cylinder assembly 14*a* and a removable nose assembly 16*a***.

The piston-cylinder assembly **14*a* includes a generally tubular housing 18*a* which is of a one piece construction and which has a forward cylinder cavity 20*a* and a rearward cylinder cavity 22*a* separated by an annular web or wall 24*a*. The separating wall 24*a* has a central through bore 25a and an annular fluid seal 27a supported in a groove therein. The forward cavity 20a and rearward cavity 22a are generally of the same inside diameter; however, a threaded counterbore 26a, of enlarged inside diameter, is located at the outer end of the forward cylinder cavity 20a**.

The tool 10a includes a tandem piston assembly 37a which comprises a forward piston 36a having a piston head 38a, a forwardly extending rod portion 40a and a rearwardly extending rod portion 42a. The piston head 38a is slidably supported within forward cylinder cavity 20a and has an annular seal 43a located in a groove in its outer surface to provide a fluid seal therewith.

A generally annular gland nut 44a is threadably secured within the counterbore 26a and has a central bore 46a for slidably supporting the forward rod portion 40a. An annular seal 48a located in a groove in central bore 46a provides a fluid seal with the forward rod portion 40a; at the same time, a seal 50a in an annular groove in an outer surface of gland nut 44a provides a fluid seal with the forward cylinder cavity 20a. The gland nut 44a has an enlarged clearance counterbore 52a at its forward end and a radial set screw 53a inhibits rotation between the gland nut 44a and housing 18a. Thus, the gland nut 44a along with the web 24a and forward cylinder cavity 20a define a forward cylinder 54a.

The rearward rod portion 42a is slidably supported within web bore 25a with seal 27a providing a fluid seal therewith. The rearward rod portion 42a extends into a through bore 55a of a piston head 60a and terminates at its free end in a reduced diameter threaded portion 56a which is adapted to threadably engage a threaded portion 58a of bore 55a. A radial set screw 29a through piston head 60a holds the piston head 60a from rotation relative to the rear rod portion 42a. The piston head 60a is slidably supported within the rearward cylinder cavity 22a and has an annular seal 62a located in a groove in its outer surface to provide a seal with cylinder cavity 22a. Thus the separating wall 24a and piston head 60a define a rearward cylinder 64a.

As with the embodiment of FIG. 1, while the forward cylinder 54a has operative cylinder portions on opposite sides of forward piston head 38a, the rearward cylinder 64a is operatively defined only on one side of the rear piston head 60a. Again, fluid pressure can be applied to both sides of forward piston head 38a but only to one side of rear piston head 60a. Thus the tandem piston assembly 37a will move axially rearwardly in response to fluid pressure applied to one side each of both the forward piston head 38a and rear piston head 60a (for the pull stroke of tool 10a) but will move axially forwardly in response to fluid pressure applied only to the opposite side of the front piston head 38a (for the return stroke of tool 10a). This is accomplished by fluid passageways in conjunction with a power supply such as the hydraulic power supply 12 of FIG. 1 in a similar manner as the tool 10 of FIG. 1.

Thus an axially and radially extending passageway 170 in web 24a terminates at its outer end in an enlarged, threaded portion adapted to receive an appropriate fluid fitting 68a. The inner end of passageway 170 opens into rearward cylinder 64a. A blind bore 70a communicates with a stepped cavity 184 in forward piston rod portion 40a and extends axially through the rear piston rod portion 42a from forward piston head 38a to a position proximate the rear piston head 60a. A threaded plug 74a blocks the open end of blind bore 70a at piston head 38a while a skewed cross bore 76a communicates the bore 70a with the front cylinder portion of forward cylinder 54a. A radial cross port 78a in the rear rod portion 42a communicates the blind bore 70a with the rearward cylinder 64a. Thus a fluid connection with the hydraulic source (such as source 12) will be simultaneously made to both cylinder 54a and 64a via line 100a, fitting 68a, passageway 170 to rearward cylinders 64a, radial cross port 78a, blind bore 70a and skewed port 76a to the front cylinder portion of forward cylinder 54a.

A second circumferentially offset and axially and radially extending passageway 173 in web 24a terminates at its outer end in an enlarged, threaded portion adapted to receive a fluid fitting 82a. The inner end of passageway 172 opens into the rear cylinder portion of forward cylinder 54a. An annular seal 86a located in a groove in rear piston bore 55a provides a fluid seal with the bore 55a relative to the fluid in rearward cylinder 64a. Thus a second fluid connection with the source (such as source 12 of FIG. 1) will be made solely to the rear cylinder portion of forward cylinder 54a via line 108a, fitting 82a, and passageway 172. Note that passageway 172 and fitting 82a are shown diametrically opposed to passageway 170 and fitting 68a as a drawing convenience and would preferably be located in a substantially side-by-side orientation.

The reciprocation of the tandem piston assembly 37a for its pull and return strokes is effectuated by the fluid connections to a source of fluid pressure such as source 12 of FIG. 1 in the same manner as tool 12.

In the embodiment of FIG. 2, radial expansion of the cylinders 54a and 64a is inhibited by annular ribs 174 and 176 which increase the radial or hoop stiffness of the housing 12a in the region of cylinders 54a and 64a. The ribs 174 and 176 are located at the ends of the cylinders 54a and 64a to provide the stiffness in the area near the end of the pull stroke at which position the applied fluid pressure will be near its maximum magnitude. This structure permits the remainder of the cylinder walls to be of a thickness less than that if a uniform wall thickness were used throughout. The result, in view of the latter and because of the tandem piston-cylinder construction, is a significant reduction in weight and overall size in contrast to a comparable single piston-cylinder combination.

In addition, as with the embodiment of FIG. 1, the rear cylinder cavity 22a is not subject to hydraulic pressure at its rearward end and hence it does not require a closure structure which must be of sufficient strength to withstand the fluid pressures applied to the working portions of cylinders 54a and 64a. The piston head 60a, however, is constructed of a ferrous material and, as such, has a reduced axial section in shear in comparison to the piston head 60 of FIG. 1. In order to prevent objects from inadvertently moving into or being caught in the open end of the rear cylinder cavity 22a, a lightweight end cap 178, which is held to the housing 12a by a plurality of bolts 180, is provided.

As with, the tool 10 of FIG. 1, tool 10a is constructed for the installation of two piece, lockbolt type fasteners which can be set by utilizing nose assembly 16a which is substantially the same as nose assembly 16 of FIG. 1. Thus in FIG. 2 the nose assembly 16a is clamped against the gland nut 44a via a nut member 182 which is threadably connected to housing 12a at the threaded counterbore 26a. The enlarged, stepped axial bore 184 in forward piston rod portion 40a receives the jaw release assembly 154a. The ejector pin 162a has a rearward extending shank portion 171a which extends partially into enlarged bore 184 and partially within ejector spring 168*a*. In all other respects the nose assembly 16*a* is the same as nose assembly 16 and hence the description of the other similarly numbered components and their general operation will not be repeated.

Thus the installation tool and system of the present invention includes a tandem piston-cylinder installation tool for setting large diameter lockbolt type fasteners requiring high axial loads, with the tool operable from a source of hydraulic pressure of a generally high magnitude and with the tool being of a reduced weight and size in contrast to comparable single piston-cylinder tools.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. In a fastening system for setting a fastener such as a lockbolt including a pin and a collar by applying a relative axial force between the pin and collar, said system comprising: an installation tool and a hydraulic power supply, said installation tool including a piston-cylinder assembly and a removable nose assembly, said piston-cylinder assembly comprising a one piece cylinder housing, said housing having an annular, radially extending separating wall located intermediate its ends and defining a forwardly opening cylinder cavity which is coaxially in line with a rearwardly opening cylinder cavity, said piston-cylinder assembly further comprising an annular closure member located at the front end of said forwardly opening cylinder cavity to define therewith a forward cylinder, said piston-cylinder assembly also comprising a tandem piston assembly including a first piston structure comprising a first piston head slidingly supported in said forward cylinder and integrally formed with a forwardly extending rod portion and a rearwardly extending rod portion, said forward rod portion slidingly supported in and extending through an opening in said closure member, said rearward rod portion slidingly supported in and extending through an opening in said separating wall, said tandem piston assembly further including a second piston structure comprising a second piston head secured to said rearwardly extending rod portion and slidably supported in said rearward cylinder cavity for reciprocal movement with said first piston structure, said first piston structure and said closure member defining a front cylinder portion in said forward cylinder, said first piston structure and said separating wall defining a rear cylinder portion in said forward cylinder, said second piston structure and said separating wall defining in said rearward cylinder cavity a rearward cylinder operative only on the side of said second piston head connected to said rearward rod portion, said rearward cylinder being the only fluid cylinder defined in said rearward cylinder cavity and operative on said second piston structure, said nose assembly including a plurality of jaws adapted to grip a pull portion of the pin and further including a swage anvil having a swage cavity adapted to engage the collar and to move over the collar and swage it radially inwardly onto the pin in response to a relative axial pull force between said jaws and said swage anvil as applied to the pin and collar, said swage cavity having a throat portion of a non-self releasing configuration, first means connecting said swage anvil to said cylinder housing and second means connecting said forward rod portion of said piston-cylinder assembly to said jaws, first fluid passage means in said piston-cylinder assembly for communicating said rearward cylinder and said front cylinder portion of said forward cylinder for simultaneously applying fluid pressure thereto from said hydraulic power supply to urge said first and second piston structures rearwardly to apply an axial pulling force to the fastener pin via said jaws and an axial reaction force to the collar via said swage anvil to set the fastener, said first fluid passage means including a first fluid inlet and a first passageway connected to said first fluid inlet, said first passageway extending through said rearward rod portion and said first piston head, second fluid passage means in said piston-cylinder assembly including a second fluid inlet for communication to said rear cylinder portion of said forward cylinder for applying fluid pressure thereto from said hydraulic power supply to urge said first piston structure forwardly to apply an axial pushing force to the end of the swaged fastener collar and an axial reaction force to said swage anvil to release the swaged collar from said swage cavity after the fastener has been set, said hydraulic power supply having a pull pressure section for providing hydraulic pressure of a first preselected magnitude to said piston-cylinder assembly, a return pressure section for providing hydraulic pressure of a second preselected magnitude to said piston-cylinder assembly, and a tank section for providing a reservoir for fluid to be returned from said piston-cylinder assembly, said hydraulic power supply including control valve means operable to a first condition for connecting said pull pressure section to said first fluid inlet of said piston-cylinder assembly for applying the relative axial pull force to set the fastener and for connecting said tank section to said second fluid inlet to receive fluid exhausted from said rear cylinder portion of said forward cylinder and operable to a second condition for connecting said return pressure section to said second fluid inlet of said piston-cylinder assembly for applying the relative axial pushing force for releasing the swaged collar from said swage cavity and for connecting said tank section to said first fluid inlet to receive exhausted fluid from said rearward cylinder and from said front cylinder portion of said forward cylinder, said second magnitude of hydraulic pressure being at least around 0.70 of said first magnitude of hydraulic pressure and with said relative axial pushing force being no less than around 0.30 of said relative axial pulling force.

2. The fastening system of claim 1 with the wall thickness of said forward and rearward cylinders being selected relative to the magnitude of the hydraulic fluid pressure applied thereto to be the minimum thickness required for providing sufficient hoop stiffness to said forward and rearward cylinders whereby fluid leakage past said first and second piston heads is inhibited.

3. The fastening system of claim 1 with the wall thickness of said forward and rearward cylinders being selected relative to the magnitude of the hydraulic fluid pressure applied thereto to be the minimum thickness required for providing sufficient hoop stiffness to said forward and rearward cylinders whereby fluid leakage past said first and second piston heads is inhibited, said cylinder housing having a generally uniform outside diameter in the region of said forward and rearward cylinders.

4. The fastening system of claim 1 with the wall thickness of said forward and rearward cylinders being selected relative to the magnitude of the hydraulic fluid pressure applied thereto to be the minimum thickness required for providing sufficient hoop stiffness to said forward and rearward cylinders whereby fluid leakage past said first and second piston heads is inhibited, said cylinder housing having a ribbed exterior structure at the rearward ends of said forward and rearward cylinders whereby said hoop stiffness will be increased in the positions of the associated pistons at which hydraulic fluid pressure will be a maximum for applying said relative axial pulling force.

5. In a fastening system for setting a fastener such as a lockbolt including a pin and a collar by applying a relative axial force between the pin and collar, said system comprising: an installation tool and a hydraulic power supply.

said installation tool including a piston-cylinder assembly and a removable nose assembly, said piston-cylinder assembly comprising a one piece cylinder housing, said housing having an annular, radially extending separating wall located intermediate its ends and defining a forwardly opening cylinder cavity which is coaxially in line with a rearwardly opening cylinder cavity, said piston-cylinder assembly further comprising an annular closure member located at the front end of said forwardly opening cylinder cavity to define therewith a forward cylinder, said piston-cylinder assembly also comprising a tandem piston assembly including a first piston structure comprising a first piston head slidingly supported in said forward cylinder and integrally formed with a forwardly extending rod portion and a rearwardly extending rod portion, said forward rod portion slidingly supported in and extending through an opening in said closure member, said rearward rod portion slidingly supported in and extending through an opening in said separating wall, said tandem piston assembly further including a second piston structure comprising a second piston head secured to said rearwardly extending rod portion and slidably supported in said rearward cylinder cavity for reciprocal movement with said first piston structure, said first piston structure and said closure member defining a front cylinder portion in said forward cylinder, said first piston structure and said separating wall defining a rear cylinder portion in said forward cylinder, said second piston structure and said separating wall defining in said rearward cylinder cavity a rearward cylinder operative only on the side of said second piston head connected to said rearward rod portion, said rearward cylinder being the only fluid cylinder defined in said rearward cylinder cavity and operative on said second piston structure, said nose assembly including a plurality of jaws adapted to grip a pull portion of the pin and further including a swage anvil having a swage cavity adapted to engage the collar and to move over the collar and swage it radially inwardly onto the pin in response to a relative axial pull force between said jaws and said swage anvil as applied to the pin and collar.

first means connecting said swage anvil to said cylinder housing and second means connecting said forward rod portion of said piston-cylinder assembly to said jaws, first fluid passage means in said piston-cylinder assembly for communicating said rearward cylinder and said front cylinder portion of said forward cylinder for simultaneously applying fluid pressure thereto from said hydraulic power supply to urge said first and second piston structures rearwardly to apply an axial pulling force to the fastener pin via said jaws and an axial reaction force to the collar via said swage anvil to set the fastener, said first fluid passage means including a first fluid inlet and a first passageway connected to said first fluid inlet, said first passageway extending through said rearward rod portion and said first piston head, second fluid passage means in said piston-cylinder assembly including a second fluid inlet for communication to said rear cylinder portion of said forward cylinder for applying fluid pressure thereto from said hydraulic power supply to urge said first piston structure forwardly to apply an axial pushing force to the end of the swaged fastener collar and an axial reaction force to said swage anvil to release the swaged collar from said swage cavity after the fastener has been set, said hydraulic power supply having a pull pressure section for providing hydraulic pressure of a first preselected magnitude to said piston-cylinder assembly, a return pressure section for providing hydraulic pressure of a second preselected magnitude to said piston-cylinder assembly, and a tank section for providing a reservoir for fluid to be returned from said piston-cylinder assembly, said hydraulic power supply including control valve means operable to a first condition for connecting said pull pressure section to said first fluid inlet of said piston-cylinder assembly for applying the relative axial pull force to set the fastener and for connecting said tank section to said second fluid inlet to receive fluid exhausted from said rear cylinder portion of said forward cylinder and operable to a second condition for connecting said return pressure section to said second fluid inlet of said piston-cylinder assembly for applying the relative axial pushing force for releasing the swaged collar from said swage cavity and for connecting said tank section to said first fluid inlet to receive exhausted fluid from said rearward cylinder and from said front cylinder portion of said forward cylinder.

6. In a fastening system for setting a fastener such as a lockbolt including a pin and a collar by applying a relative axial force between the pin and collar, said system comprising: an installation tool and a hydraulic power supply, said installation tool including a piston-cylinder assembly and a nose assembly, said piston-cylinder assembly comprising a cylinder housing, said housing having an annular, radially extending separating wall located intermediate its ends and defining a forwardly opening cylinder cavity which is coaxially in line with a rearwardly opening cylinder cavity, said piston-cylinder assembly further comprising an annular closure member located at the front end of said forwardly opening cylinder cavity to define therewith a forward cylinder, said piston-cylinder assembly also comprising a tandem piston assembly including a first piston structure comprising a first piston head slidingly supported in said forward cylinder and having secured thereto a forwardly extending rod portion and a rearwardly extending rod portion, said forward rod portion slidingly supported in and extending through an opening in said closure member, said rearward rod portion slidingly supported in and extending through an opening in said separating wall, said tandem piston assembly further including a second piston structure comprising a second piston head secured to said rearwardly extending rod portion and slidably supported in said rearward cylinder cavity for reciprocal movement with said first piston structure, said first piston structure and said closure member defining a front cylinder portion in said forward cylinder, said first piston structure and said separating wall defining a rear cylinder portion in said forward cylinder, said second piston structure and said separating wall defining in said rearward cylinder cavity a rearward cylinder operative only on the side of said second piston head connected to said rearward rod portion, said rearward cylinder being the only fluid cylinder defined in said rearward cylinder cavity and operative on said second piston structure, said nose assembly including a plurality of jaws adapted to grip a pull portion of the pin and further including a swage anvil having a swage cavity adapted to engage the collar and to move over the collar and swage it radially inwardly onto the pin in response to a relative axial pull force between said jaws and said swage anvil as applied to the pin and collar, first means connecting said swage anvil to said cylinder housing and second means connecting said forward rod portion of said piston-cylinder assembly to said jaws, first fluid passage means in said piston-cylinder assembly for communicating said rearward cylinder and said front cylinder portion of said forward cylinder for simultaneously applying fluid pressure thereto from said hydraulic power supply to urge said first and second piston structures rearwardly to apply an axial pulling force to the fastener pin via said jaws and an axial reaction force to the collar via said swage anvil to set the fastener, said first fluid passage means including a first fluid inlet and a first passageway connected to said first fluid inlet, said first passageway extending through said rearward rod portion and said first piston head, second fluid passage means in said piston-cylinder assembly including a second fluid inlet for communication to said rear cylinder portion of said forward cylinder for applying fluid pressure thereto from said hydraulic power supply to urge first piston structure forwardly to apply an axial pushing force to the end of the swaged fastener collar and an axial reaction force to said swage anvil to release the swaged collar from said swage cavity after the fastener has been set, said hydraulic power supply having a pressure section for providing hydraulic pressure of a preselected magnitude to said piston-cylinder assembly and a tank section for providing a reservoir for fluid to be returned from said piston-cylinder assembly, said hydraulic power supply including control valve means operable to a first condition for connecting said pressure section to said first fluid inlet of said piston-cylinder assembly for applying the relative axial pull force to set the fastener and for connecting said tank section to said second fluid inlet to receive fluid exhausted from said rear cylinder portion of said forward cylinder and operable to a second condition for connecting said return pressure section to said second fluid inlet of said piston-cylinder assembly for applying the relative axial pushing force for releasing the swaged collar from said swage cavity and for connecting said tank section to said first fluid inlet to receive fluid exhausted from said rearward cylinder and from said front cylinder portion of said forward cylinder.

7. The fastening system of claim 6 with said second piston head having an axial length no less than around the axial length of said rearward cylinder cavity.

8. The fastening system of claim 6 with said second piston head having an axial length no less than around the axial length of said rearward cylinder cavity, said second fluid passage means including a second fluid passageway connected to said second fluid inlet and extending generally axially through said rearward rod portion.

9. The fastening system of claim 6 with said second piston head having an axial length no less than around the axial length of said rearward cylinder cavity, said second fluid passage means including a second fluid passageway connected to said second fluid inlet and extending generally axially through said rearward rod portion, said first and second fluid inlets opening rearwardly of said rearward cylinder and having fluid fittings for connection to fluid lines from said hydraulic power supply.

10. The fastening system of claim 6 with said second piston head having an axial length no less than around the axial length of said rearward cylinder cavity, said second fluid passage means including a second fluid passageway connected to said second fluid inlet and extending generally axially through said rearward rod portion, said first and second fluid inlets opening rearwardly of said rearward cylinder and having fluid fittings for connection to fluid lines from said hydraulic power supply, said first fluid passage means including a piston passageway connected to said first fluid inlet and extending axially through said first piston head to communicate with said rearward cylinder, said first fluid passage means including a connecting passage for communicating said piston passageway with said first fluid passageway.

11. In a fastening system for setting a fastener such as a lockbolt including a pin and a collar by applying a relative axial force between the pin and collar, said system comprising: an installation tool and a hydraulic power supply, said installation tool including a piston-cylinder assembly and a nose assembly, said piston-cylinder assembly comprising a cylinder housing. said housing having an annular, radially extending separating wall located intermediate its ends and defining a forwardly opening cylinder cavity which is coaxially in line with a rearwardly opening cylinder cavity, said piston-cylinder assembly further comprising an annular closure member located at the front end of said forwardly opening cylinder cavity to define therewith a forward cylinder, said piston-cylinder assembly also comprising a tandem piston assembly including a first piston structure comprising a first piston head slidingly supported in said forward cylinder and having secured thereto a forwardly extending rod portion and a rearwardly extending rod portion, said forward rod portion slidingly supported in and extending through an opening in said closure member, said rearward rod portion slidingly supported in and extending through an opening in said separating wall, said tandem piston assembly further including a second piston structure comprising a second piston head secured to said rearwardly extending rod portion and slidably supported in said rearward cylinder cavity for reciprocal movement with said first piston structure, said first piston structure and said closure member defining a front cylinder portion in said forward cylinder, said first piston structure and said separating wall defining a rear cylinder portion in said forward cylinder, said second piston structure and said separating wall defining in said rearward cylinder cavity a rearward cylinder operative only on the side of said second piston head connected to said rearward rod portion, said rearward cylinder being the only fluid cylinder defined in said rearward cylinder cavity and operative on said second piston structure, said nose assembly including a plurality of jaws adapted to grip a full portion of the pin and further including a swage anvil having a swage cavity adapted to engage the collar and to move over the collar and swage it radially inwardly onto the pin in response to a relative axial pull force between said jaws and said swage anvil as applied to the pin and collar, first means connecting said swage anvil to said cylinder housing and second means connecting said forward rod portion of said piston-cylinder assembly to said jaws, first fluid passage means in said piston-cylinder assembly for communicating said rearward cylinder and said front cylinder portion of said forward cylinder for simultaneously applying fluid pressure thereto from said hydraulic power supply to urge said first and second piston structures rearwardly to apply an axial pulling force to the fastener pin via said jaws and an axial reaction force to the collar via said swage anvil to set the fastener, second fluid passage means in said piston-cylinder assembly for communication to said rear cylinder portion of said forward cylinder for applying fluid pressure thereto from said hydraulic power supply to urge said first piston structure forwardly to apply an axial pushing force to the end of the swaged fastener collar and on axial reaction force to said swage anvil to release the swaged collar from said swage cavity after the fastener has been set, said hydraulic power supply having a pressure section for providing hydraulic pressure of a preselected magnitude to said piston-cylinder assembly and a tank section for providing a reservoir for fluid to be returned from said piston-cylinder assembly.

said hydraulic power supply including control valve means operable to a first condition for connecting said pressure section to said first fluid passage means of said piston-cylinder assembly for applying the relative axial pull force to set the fastener and for connecting said tank section to said second fluid passage means to receive fluid exhausted from said rear cylinder portion of said forward cylinder and operable to a second condition for connecting said return pressure section to said second fluid passage means of said piston-cylinder assembly for applying the relative axial pushing force for releasing the swaged collar from said swage cavity and for connecting said tank section to said first fluid passage means to receive fluid exhausted from said rearward cylinder and from said front cylinder portion of said forward cylinder.

12. The fastening system of claim 11 with the wall thickness of said forward and rearward cylinders being selected relative to the magnitude of the hydraulic fluid pressure applied thereto to be the minimum thickness required for providing sufficient hoop stiffness to said forward and rearward cylinders whereby fluid leakage past said first and second piston heads is inhibited.

13. The fastening system of claim 11 with the wall thickness of said forward and rearward cylinders being selected relative to the magnitude of the hydraulic fluid pressure applied thereto to be the minimum thickness required for providing sufficient hoop stiffness to said forward and rearward cylinders whereby fluid leakage past said first and second piston heads is inhibited, said cylinder housing having a generally uniform outside diameter in the region of said forward and rearward cylinders.

14. The fastening system of claim 11 with the wall thickness of said forward and rearward cylinders being selected relative to the magnitude of the hydraulic fluid pressure applied thereto to be the minimum thickness required for providing sufficient hoop stiffness to said forward and rearward cylinders whereby fluid leakage past said first and second piston heads is inhibited, said cylinder housing having a ribbed exterior structure at the rearward ends of said forward and rearward cylinders whereby said hoop stiffness will be increased in the positions of the associated pistons at which hydraulic fluid pressure will be a maximum for applying said relative axial pulling force.

15. The fastener system of claim 11 with said second piston head having an axial length no less than around the axial length of said rearward cylinder cavity.

16. In a fastening system for setting a fastener such as a lockbolt including a pin and a collar by applying a relative axial force between the pin and collar, the system comprising an installation tool and a hydraulic power supply, said installation tool including a piston-cylinder assembly and a nose assembly, said piston-cylinder assembly comprising a cylinder housing, said housing having an annular, radially extending separating wall located intermediate its ends and defining a forwardly opening cylinder cavity which is coaxially in line with a rearwardly opening cylinder cavity, said piston-cylinder assembly further comprising an annular closure member located at the front end of said forwardly opening cylinder cavity to define therewith a forward cylinder, said piston-cylinder assembly also comprising a tandem piston assembly including a first piston structure comprising a first piston head slidingly supported in said forward cylinder and having secured thereto a forwardly extending rod portion and a rearwardly extending rod portion, said forward rod portion slidingly supported in and extending through an opening in said closure member, said rearward rod portion slidingly supported in and extending through an opening in said separating wall, said tandem piston assembly further including a second piston structure comprising a second piston head secured to said rearwardly extending rod portion and slidably supported in said rearward cylinder cavity for reciprocal movement with said first piston structure, said first piston structure and said closure member defining a front cylinder portion in said forward cylinder, said first piston structure and said separating wall defining a rear cylinder portion in said forward cylinder, said second piston structure and said separating wall defining in said rearward cylinder cavity a rearward cylinder operative only on the side of said second piston head connected to said rearward rod portion, said rearward cylinder being the only fluid cylinder defined in said rearward cylinder cavity and operative on said second piston structure, said nose assembly including a plurality of jaws adapted to grip a full portion of the pin and further including a swage anvil having a swage cavity adapted to engage the collar and to move over the collar and swage it radially inwardly onto the pin in response to a relative axial pull force between said jaws and said swage anvil as applied to the pin and collar, first means connecting said swage anvil to said cylinder housing and second means connecting said forward rod portion of said piston-cylinder assembly to said jaws, first fluid passage means in said piston-cylinder assembly for communicating said rearward cylinder and said front cylinder portion of said foward cylinder for simultaneously applying fluid pressure thereto from said hydraulic power supply to urge said first and second piston structures rearwardly to apply an axial pulling force to the fastener pin via said jaws and an axial reaction force to the collar via said swage anvil to set the fastener, second fluid passage means in said piston-cylinder assembly for communication to said rear cylinder portion of said forward cylinder for applying fluid pressure thereto from said hydraulic power supply to urge said first piston structure forwardly to apply an axial pushing force to the end of the swaged fastener collar and an axial reaction force to said swage anvil to release the swaged collar from said swage cavity after the fastener has been set, said hydraulic power supply having a pressure section for providing hydraulic pressure of a preselected magnitude to said piston-cylinder assembly and a tank section for providing a reservoir for fluid to be returned from said piston-cylinder assembly, said hydraulic power supply including control valve means operable to a first condition for connecting said pressure section to said first fluid passage means of said piston-cylinder assembly for applying the relative axial pull force to set the fastener and for connecting said tank section to said second fluid passage means to receive fluid exhausted from said rear cylinder portion of said forward cylinder and operable to a second condition for connecting said return pressure section to said second fluid passage means of said piston-cylinder assembly for applying the relative axial pushing force for releasing the swaged collar from said swage cavity and for connecting said tank section to said first fluid passage means to receive fluid exhausted from said rearward cylinder and from said front cylinder portion of said forward cylinder, the method of constructing said piston-cylinder assembly comprising the steps of:

selecting the wall thickness of said forward and rearward cylinders relative to the magnitude of the hydraulic fluid pressure applied thereto to be the minimum thickness required for providing sufficient hoop stiffness to said forward and rearward cylinders whereby fluid leakage past said first and second piston heads is inhibited, said wall thickness selected in a relationship in accordance with said magnitude of hydraulic fluid pressure such that when applied to one said installation tool being operative to provide said relative axial pulling force of around 23,000 pounds when said magnitude of hydraulic pressure is around 5,500 psi, said cylinder housing being constructed of a ferrous material will have said forward and rearward cylinders with an inside diameter of around 1.562 inches and an effective outside diameter of around 1.75 inches.

17. The fastening system of claim 16 including the steps of:

constructing said cylinder housing of one piece with said separating wall integrally formed between said forwardly and rearwardly opening cylinder cavities.

18. The fastening system of claim 16 including the steps of:

constructing said tandem piston assembly with said first piston head formed integrally with said forwardly and rearwardly extending rod portions.

19. The fastening system of claim 18 with said rearwardly extending rod portion having an axially extending passageway defining a portion of said second fluid passage means.

* * * * *

UNITED STATES PATENT AND TRADEMARK OFFICE

CERTIFICATE OF CORRECTION

PATENT NO. : 4,587,829

DATED : May 13, 1986

INVENTOR(S) : Boris P. Sukharevsky

It is certified that error appears in the above-identified patent and that said Letters Patent is hereby corrected as shown below:

Column 3, line 51, delete "26" and substitute therefor --16--.
Column 10, line 11, delete "173" and substitute therefor --172--.
Column 13, line 30, delete "." and substitute therefor --,--.
Column 16, line 3, after "urge" insert --said--.
Column 17, line 9, delete "." and substitute therefor --,--.
Column 18, line 14, delete "." and substitute therefor --,--.
Column 18, line 63, delete "fastener" and substitute therefor --fastening--.

Signed and Sealed this

Seventeenth Day of February, 1987

*Attest:*

DONALD J. QUIGG

*Attesting Officer* *Commissioner of Patents and Trademarks*